US008735751B2

(12) United States Patent
Rust

(10) Patent No.: US 8,735,751 B2
(45) Date of Patent: May 27, 2014

(54) VARYING DIAMETER CANTED COIL SPRING CONTACTS AND RELATED METHODS OF FORMING

(75) Inventor: Steve Rust, Foothill Ranch, CA (US)

(73) Assignee: Bal Seal Engineering, Inc., Foothill Ranch, CA (US)

( * ) Notice: Subject to any disclaimer, the term of this patent is extended or adjusted under 35 U.S.C. 154(b) by 155 days.

(21) Appl. No.: 13/453,337

(22) Filed: Apr. 23, 2012

(65) Prior Publication Data

US 2012/0273332 A1 Nov. 1, 2012

Related U.S. Application Data

(60) Provisional application No. 61/479,039, filed on Apr. 26, 2011, provisional application No. 61/538,533, filed on Sep. 23, 2011.

(51) Int. Cl.
*H01H 1/06* (2006.01)

(52) U.S. Cl.
USPC ..... 200/276; 439/840

(58) Field of Classification Search
USPC ..... 200/275; 439/840, 841; 324/754.14
IPC ..... H01R 13/18,13/187, 13/2421
See application file for complete search history.

(56) References Cited

U.S. PATENT DOCUMENTS

| | | | | |
|---|---|---|---|---|
| 3,885,848 | A * | 5/1975 | Brouneus | 439/841 |
| 4,632,496 | A * | 12/1986 | Williams | 439/841 |
| 5,906,520 | A * | 5/1999 | Frinker et al. | 439/841 |
| 6,247,943 | B1 * | 6/2001 | Moga et al. | 439/125 |
| 6,471,554 | B2 * | 10/2002 | Armistead et al. | 439/841 |
| 7,055,812 | B2 * | 6/2006 | Balsells | 267/167 |
| 2003/0171034 | A1 * | 9/2003 | Edwards et al. | 439/620 |
| 2003/0176113 | A1 * | 9/2003 | Sasaki | 439/700 |
| 2006/0172613 | A1 * | 8/2006 | Sasaki | 439/824 |
| 2011/0121850 | A1 * | 5/2011 | Lee | 324/756.02 |

* cited by examiner

*Primary Examiner* — Vanessa Girardi
(74) *Attorney, Agent, or Firm* — Klein, O'Neill & Singh, LLP

(57) ABSTRACT

A contact assembly is disclosed herein with a spring contact located in a housing wherein a plurality of coils of the spring contact are interconnected with one another and all slanted or canted. The coils further have outside diameters of different outside dimensions, such as one section of the spring contact having a larger outside diameter than the other section or sections of the spring contact. When inside the interior cavity of the housing, the first end and the second end are spaced from one another and wherein some of the plurality of coils do not contact the housing. A pin, rod, or shaft is locatable in a passage of the spring contact of the contact assembly but less than all of the coils of the spring contact grip against the exterior surface of the pin, rod or shaft.

22 Claims, 9 Drawing Sheets

FIG. 5
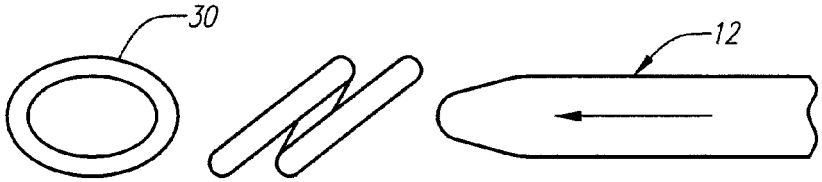
FIG. 6
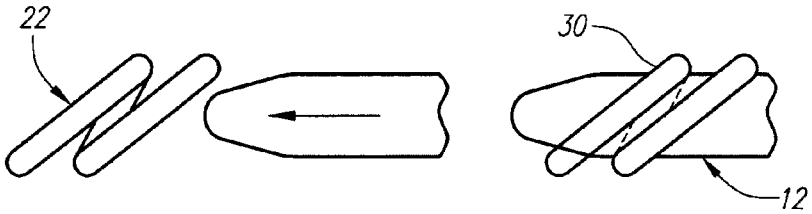
FIG. 7
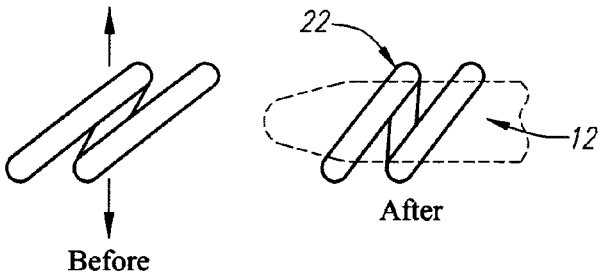
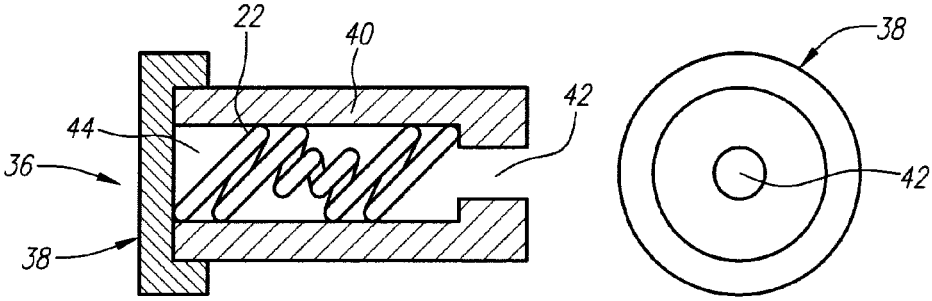
FIG. 8
FIG. 9
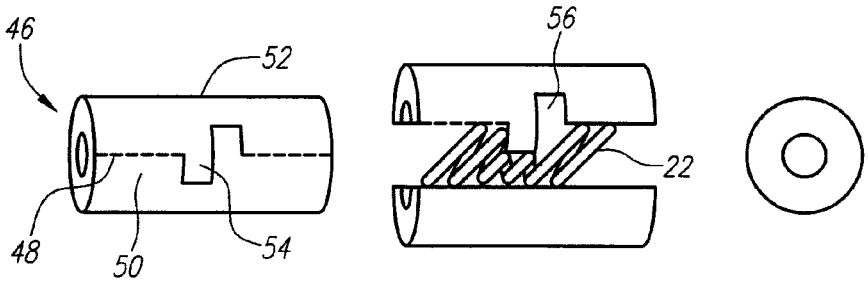

VARYING DIAMETER CANTED COIL SPRING CONTACTS AND RELATED METHODS OF FORMING

CROSS-REFERENCE TO RELATED APPLICATIONS

This is a regular utility application of provisional application Ser. No. 61/479,039, filed Apr. 26, 2011, and of provisional application Ser. No. 61/538,533, filed Sep. 23, 2011, the contents of each of which are expressly incorporated herein by reference as if set forth in full.

FIELD OF ART

Aspects of the present device, system, and method pertain to electrical contacts, particularly to electrical coiled spring contacts.

BACKGROUND

Coiled spring contacts have been used in electrical applications as electrical contacts or means for transferring electric signals or energy between a pin and housing. Typically, such as in the case of canted-coil spring contacts, a length of coiled spring is joined at the ends to form a contact ring, where the pin contacts the canted-coil spring contact on the inside diameter of the contact ring and the housing contacts the spring contact on the outside diameter of the contact ring. The coils located between the pin and housing are able to deflect and thus maintain contact with the pin and the housing. However, as the size of the pin contacts decrease, such as reduce in diameter, producing such spring contacts become more challenging. Among other things, as the spring wire diameter gets smaller, the spring reduces strength and maintaining consistency in manufacturing is more difficult.

Canted coil springs for use in electrical contacts are typically sized limited to approximately three times the coil height. This limitation is typically the smallest ID of a welded spring.

SUMMARY

A new type of spring contact is provided that can be made extremely small. In one example, the spring contact includes variable coil height characteristics. The spring may be a canted coil spring. However, its two ends (i.e., its length) are not welded.

In one exemplary embodiment, the spring contact has coils that have two ends and a center section. The center section may have coils of a first diameter and the two ends may have coils of a second diameter, which is larger than the first diameter. In this example, the first diameter is configured to contact with a rod or pin and the second diameter is configured to contact with a housing.

In another embodiment, the second diameter is smaller than the first diameter. In this example, the two ends are configured to contact with a rod or pin while the center section is configured to contact with a housing.

In still yet another aspect of the present disclosure, there is provided a contact assembly comprising a housing and a spring contact located therein and in electrical contact with a pin; wherein the spring contact comprises a plurality of coils having at least two different diameters, which include a first diameter and a second smaller diameter; and wherein the coils with the second smaller diameter contact the pin but not the coils with the first diameter.

A contact assembly is disclosed herein comprising a spring contact comprising a plurality of coils interconnected with one another and having outside diameters of different outside dimensions. The spring contact comprising a first end, a second end, and a center section and wherein the plurality of coils are canted. The contact assembly further including a housing comprising an interior cavity; wherein the spring contact is located, at least in part, inside the interior cavity of the housing and wherein the first end and the second end are spaced from one another and wherein some of the plurality of coils do not contact the housing. The coils that do not contact the housing are configured to contact a rod. Thus, the rod may be placed in electrical communication with the housing by contacting the coils that only contact the rod and those coils contact other coils that are in turn in contact with the housing.

The contact assembly, wherein the first end has coils with an outside diameter that differs from an outside diameter of the second end.

The contact assembly, wherein the first end has a coil with a coil diameter that is the same as a coil diameter of at least one coil at the second end.

The contact assembly, wherein the housing has a center section having an inside diameter and wherein an opening at an end of the housing has a smaller diameter than the inside diameter of the housing.

The contact assembly, wherein the housing has a longitudinal seam along a lengthwise axis.

The contact assembly, further comprising a pin passing through a passage of the spring contact.

The contact assembly, further comprising a first source in electrical communication with a second source.

The contact assembly, wherein the first source is connected to the housing by a first cable or a first wire and the second source is connected to the pin by a second cable or a second wire.

An aspect of the present disclosure is further understood to include a method for forming a contact assembly. The method comprising providing a spring contact comprising a plurality of coils interconnected with one another and having outside diameters of different outside dimensions; the spring contact comprising a first end, a second end, and a center section and wherein the plurality of coils are canted to a respective relaxed state. The method further including the step of providing a housing comprising an interior cavity and at least one open end and placing the spring contact into the interior cavity of the housing through the at least one open end such that the first end and the second end are spaced from one another and wherein some of the plurality of coils do not contact the housing.

The method can further comprise slanting or canting the plurality of coils from their respective relaxed state prior to placing the spring contact into the interior cavity of the housing.

The method can further comprise passing a pin through a passage of the spring contact.

The method, wherein the center section of the spring contact does not contact the housing.

The method can further comprise placing a first source in electrical communication with a second source.

The method can further comprise using a first cable or a first wire to connect the first source to the contact assembly and using a second cable or a second wire to connect the second source to the pin.

The method can further comprise forming a plurality of grooves on an exterior of a pin and passing the pin through a passage of the spring contact.

A still further feature of the present disclosure is understood to include a contact assembly comprising a housing and a spring contact located therein in electrical contact with a pin, wherein the spring contact comprises a plurality of coils having at least two different diameters, which include a first diameter and a second smaller diameter and wherein the coils with the second smaller diameter contact the pin but not the coils with the first diameter.

The contact assembly, wherein the housing comprises an inlet opening comprising a width and wherein the width of the inlet opening is larger than a coil width of a largest coil.

The contact assembly, wherein the coils with the first diameter contact the housing but not the coils with the second smaller diameter.

The contact assembly, wherein the spring contact has a first end and a second end with the first diameter and a center section with the second smaller diameter.

The contact assembly, wherein the contact assembly further comprises a cap attached to one of two ends of the housing.

BRIEF DESCRIPTION OF THE DRAWINGS

These and other features and advantages of the present device, system, and method will become appreciated as the same becomes better understood with reference to the specification, claims and appended drawings wherein:

FIG. 5 is a schematic view of a section of the spring of FIG. 3 showing relative dimensions between the pin OD and the coils in a relaxed state.

FIG. 6 shows the rod inserted into the coils and in mechanical and electrical contact with the coils.

FIG. 7 depicts changes in the canting of the coils before and after accepting the pin.

FIG. 8 is a schematic partial cross-sectional side view and end view of a connector assembly having a spring with multi-dimensional coils disposed therein.

FIG. 9 is a schematic partial cross-sectional side view and end view of a connector assembly provided in accordance with another aspect of the present system and method.

DETAILED DESCRIPTION

The detailed description set forth below in connection with the appended drawings is intended as a description of the presently preferred embodiments of spring connectors, systems, and methods provided in accordance with aspects of the present device, system, and method and is not intended to represent the only forms in which the present device, system, and method may be constructed or utilized. The description sets forth the features and the steps for constructing and using the embodiments of the present device, system, and method in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Figure 1:
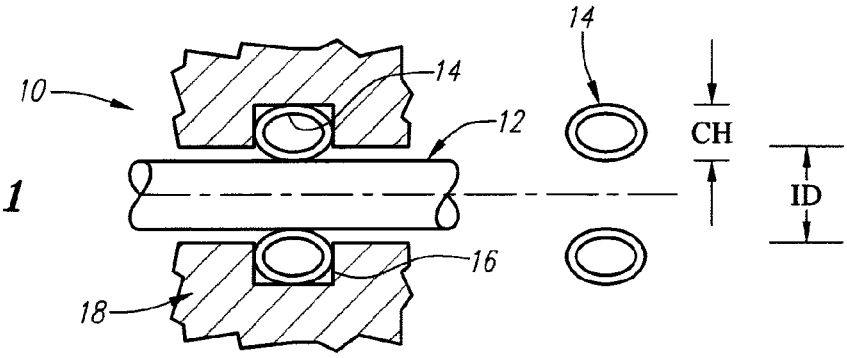
FIG. 1 is a schematic partial cross-sectional side view of a prior art connector, which shows a pin inserted into the spring ring and housing.

FIG. 1 shows a typical prior art spring contact assembly 10 in which a rod, shaft, or pin 12 is disposed through the center of a canted coil spring ring 14 and the spring is located inside a groove 16 of a housing 18. As the canted coil spring 14 is a garter-type spring, i.e., a ring, with its ends welded or connected together, the inside diameter (ID) of the spring is typically about three times the coil height of the spring, which is approximately the spring physical limitation.

Figure 2:
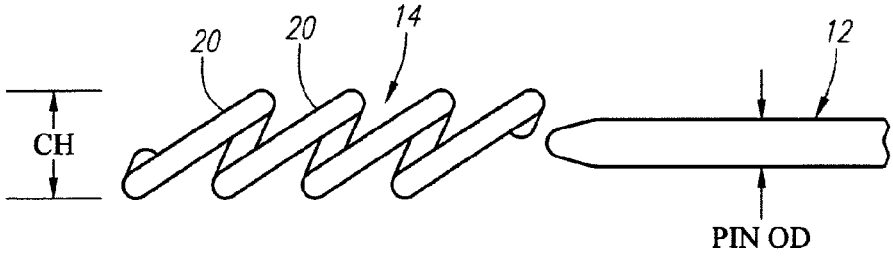
FIG. 2 is a schematic side view of a prior art spring contact, which has a generally uniform coil dimensions.

FIG. 2 shows a typical spring contact 14 with a uniform spring coil height. The spring comprises a plurality of spring coils 20 that are all canted. If a pin 12 of a certain OD is inserted into the typical contact spring or spring contact 14, there is no guarantee that the spring will contact the pin and/or the housing (not shown). For example, the openings of the deflected coils 20 may not be so deflected to enable contact with the pin 12, or the pin may be too small in diameter to contact the opening of each coil of the spring.

Figure 3:
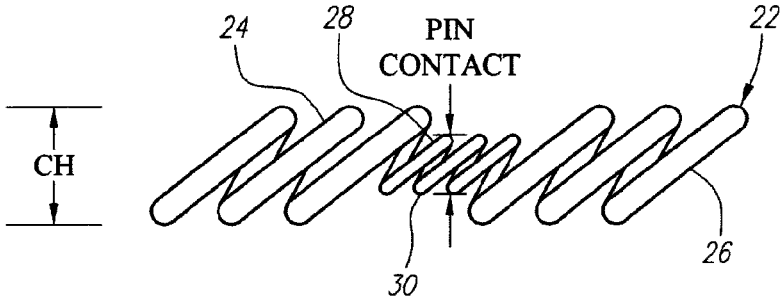
FIG. 3 is a schematic side view of a spring contact provided in accordance with the present device, system, and method.

FIG. 3 shows a contact spring 22 provided in accordance with aspects of the present apparatus, device, and method. The present contact spring 22 comprises a plurality of coils 24, two ends 26 and a center section 28 with coils 30 having different a configuration than the end coils 24. As shown, the coils 30 formed along the center section 28 have a smaller OD (outside diameter) than the coils 24 formed along the two ends 26. In one example, the smaller OD is uniform and has the same first OD. In another example, the smaller OD is not uniform and can have different ODs so long as the ODs of the center section are smaller than the ODs of the two ends 26, such as having first OD and second OD, or additional ODs with each being smaller than the OD of the end coils. In still yet another embodiment, the two ends 26 have coil ODs that are different from one another. However, they are preferably the same.

The contact spring 22 provided in accordance with aspects of the present apparatus, device, and method are configure to permit coils 30 to rod contact along the smaller OD section and coils 24 to housing contact along the larger OD end sections. Thus, aspects of the present device, system, and method include a contact spring having a plurality of coils of different dimensions so that at least some of the coils only contact a pin and at least some of the coils only contact a housing. In a specific example, the coils that only contact the pin comprise a first OD and the coils that only contact the housing comprise a second OD and wherein the second OD is larger than the first OD. In yet another example, the second OD differs at two contact spring ends. For example, the two ends may have a second OD and second OD', wherein OD is not equal to OD'.

In one example, the spring is made from a single metallurgy, such as stainless steel, copper, or metal alloy, such as zirconium-copper-chrome. In another example, the spring is made from a multi-metallic material, such as a first metal core with a second outer cladding material. For example, the multi-metallic spring may be made in accordance with U.S. application Ser. No. 12/767,421, filed Apr. 26, 2010; titled Multilayered Canted Coil Springs and Associated Methods. In one example, the spring has a stainless steel inner core and a copper or other higher conductive metal than stainless steel as an outer layer. In yet another example, the higher conductive metal is on the inside and a higher tensile strength material is on the outside.

In another embodiment, the arrangements of smaller OD and larger OD coils can vary along the length of the spring, such as alternating or random, and provide the described contacts, which are contacts between the rod and the smaller OD sections and contacts between the housing and the larger OD sections. For example, the smaller OD can be located at the two ends and contacting only a pin and the larger OD can be located between the two ends and contacting only the housing.

Figure 4:
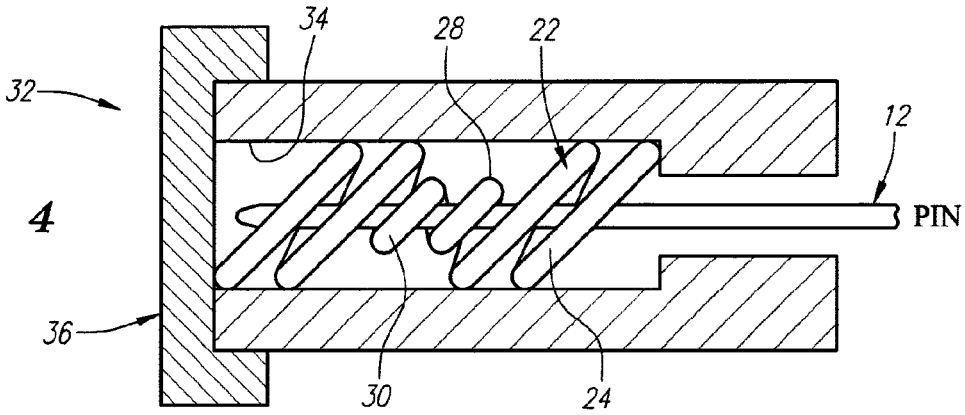
FIG. 4 is a schematic partial cross-sectional side view of a connector assembly provided in accordance with aspects of the present system and method having the spring contact of FIG. 3 disposed therein.

FIG. 4 shows a contact assembly 32 in use. As shown, the rod 12 is inserted in through the center of the coils 24, 30 and is in mechanical and electrical contact with the center section 28 of the spring 22, which has a relatively smaller OD than the ODs of the two ends. The ODs of the two ends are in mechanical and electrical contact with the interior surface 34 of the contact housing 36. Thus, electrical communication can pass from the housing 36 to the rod 12, or vice-versa, through the present contact spring 22 without all of the coils of the contact spring contacting the rod 12 or the housing 36. The spring 22 with different shaped coils may be referred to as larger OD coils 24 and smaller OD coils 30, which is understood to mean smaller in OD than the OD of the larger OD coils.

FIG. 5 shows relative sizes between the OD of the pin 12 and the 2-D (two-dimensional) inside diameter measurement of a relaxed coil 30, such as the coils at the center section 28 of the spring 22 of FIG. 4. A relaxed coil is a canted coil in its normal canted state without external induced force acting on the coil. The pin's OD is preferably larger than the ID (inside diameter) of the relaxed coil to ensure contact between the pin OD and the coils' ID when the pin 12 is inserted into the opening of the coil.

FIG. 6 and FIG. 7 show the rod 12 being inserted into and in mechanical and electrical contact with the relatively smaller OD coils 30. As the rod has a larger OD than the ID of the relaxed coils, insertion of the rod 12 causes the coils 30 to enlarge by deflecting more upwardly and less canted. Thus, insertion of the rod 12 changes the coil orientation for some of coils of the contact spring 22. For example, the rod 12, while also projecting through the center of the larger OD coils, does not change the coil orientation of the larger OD coils. The remaining spring coils 24 of the contact spring 22 not deflected by the pin or rod 12 are deflected by the housing 36. In some embodiments, one or more coils may not contact the rod or the housing. If a coil does not touch the rod or the housing, it will be suspended in space and only contact adjacent coil(s).

FIG. 8 shows a 2-piece housing 36, which includes an end cap 38 and an elongated body 40 having a center bore, which in one embodiment can be generally cylindrical body. The body 40 preferably has two open ends 42, 44, which may have the same opening sizes or different opening sizes. The housing may incorporate caps, plates, or flanges to close the ends or to reduce the size of one or both open ends. As shown, the body 40 incorporates two different end openings. In one example, one of the ends is configured to receive a contact spring 22 and the other end is configured to receive a rod. The contact spring 22 may be inserted into the cylindrical body at the larger open end 44 and secured therein with a cap 38, which may use various latching or threaded means to couple to the cylindrical body. For example, interference fit, threads, snap-on, detents, etc., may be used to secure the two components together. Optionally, the two components may be welded together. When an end cap is used, the housing is understood to include a radial seam between the cap and the elongated body.

FIG. 9 shows a 2-piece housing 46 that is joined together along a lengthwise seam 48 as opposed to a radial seam shown in FIG. 8. The two-piece housing sections 50, 52 allow the spring 22 to be placed therein and subsequently secured inside the housing 46. Various latching or fixing means may be used to secure the two housing sections 50, 52 together. In another example, the housing 46 is made from multiple housing sections and the sections may be joined together along both radial and lengthwise seams, which can be undulating or slanted. In one example, the housing sections 50, 52 may incorporate tabs 54 and cutouts 56 to facilitate engagement and alignment.

Figure 10:
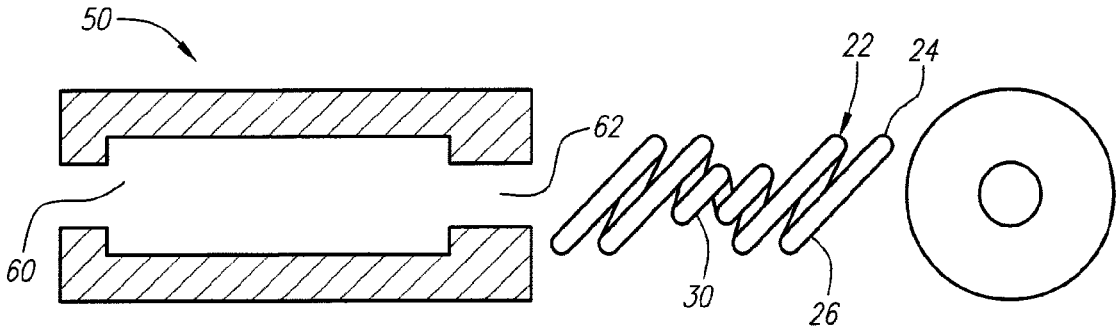
FIGS. 10-12 depict a spring being inserted into a housing by collapsing the spring to fit into a housing opening.
Figure 11:
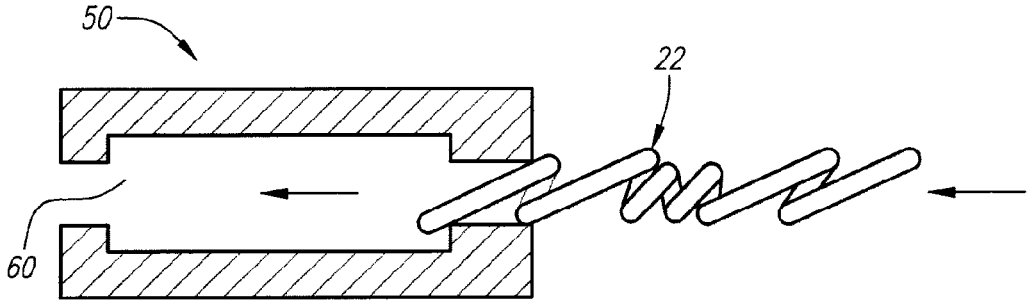
Figure 12:
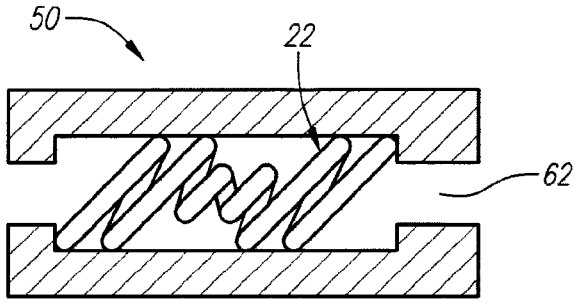

FIGS. 10-12 show different stages of installation of a contact spring 22 into a one-piece housing 58. The housing has two open ends 60, 62. As shown, the two open ends 60, 62 on the housing have openings that are smaller than the ODs of the two ends 26 of the spring contact 22. However, because the coils 24, 30 can cant (FIG. 11), the coils can be forced through one of the openings 62 and placed into the one-piece housing (FIG. 12). By canting the coils, their profile can be made smaller than the openings 60, 62 on the housing 58. In an embodiment, one or both openings 60, 62 are larger than the OD of a pin to be inserted into the housing.

Thus, a feature of the present assembly, device and method is understood to include the steps of canting a plurality of coils of a canted coil spring to insert the coils into an open end of a housing and then allowing the coils to relax after passing through the opening such that at least some of the coils contact an interior surface of the housing while at least some other coils of the spring do not contact the interior surface of the housing. The non-contacting coils can be located along a middle section of the canted coil spring or along two ends of the canted coil spring, also referred to as a spring contact. In another embodiment, the spring contact has a single large OD section and a single small OD section and the small OD section is aligned towards an opening of the housing for receiving a pin.

The coils may be a single metal coil, such as copper or brass, or a multi-metallic coil having a metal with high conductivity and low tensile strength and another metal with relatively lower conductivity but higher tensile strength, such as a combination of copper and stainless steel. In one specific example, the high conductivity metal is located in the core of the wire and the high tensile strength material forms an outer layer of the wire. In another example, the arrangement is reversed so that the high conductivity metal is located on the outside.

Figure 13:
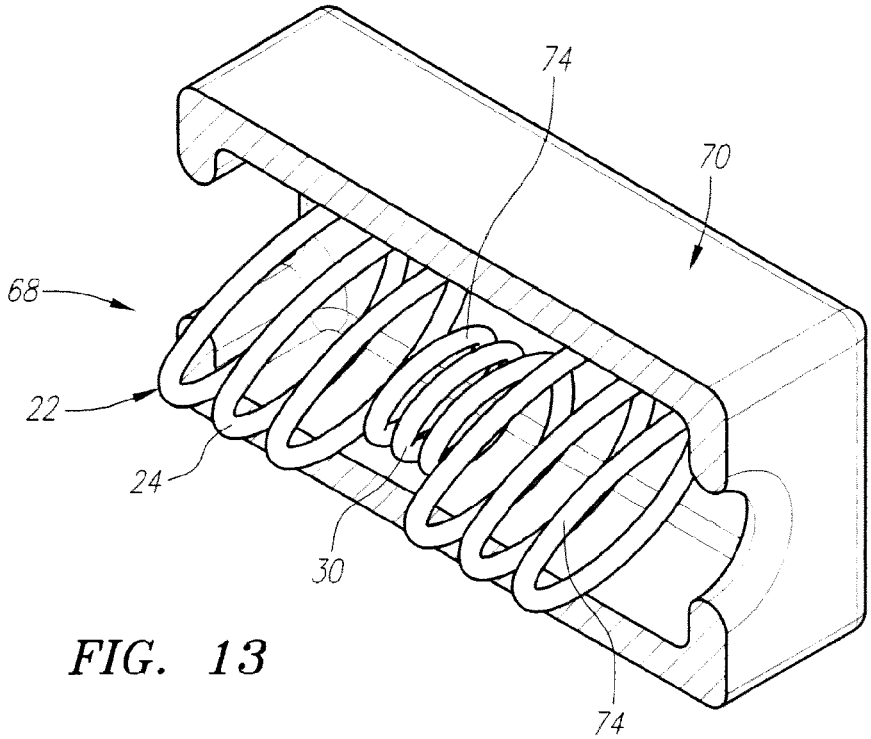
FIG. 13 is a schematic partial cross-sectional side view perspective view of a connector assembly provided in accordance with another aspect of the present system and method.

FIG. 13 shows a contact assembly 68 comprising a canted coil spring 22 with variable coil diameter located within a housing 70, which is shown in a sectional view. As shown, the larger diameter coils 24 are in contact with the housing 70 and the smaller coils 30 are available for contact with a pin. The housing may be made entirely from an electrically conductive or conducting material or from a combination of materials, such as from a first metallic metal with a second metallic cladding material. As another example, the housing may be made from an engineered plastic aligned with electrical traces or with conductive cladding layer(s) for contacting the coils. The larger coil diameter, which is larger than the constraints of the housing inside dimension, requires the coils to be tilted or canted in order to fit within the housing. The deflection that occurs from the coils being tilted more than that in the relaxed state provides a spring force against the inside surface of the housing to hold the spring in its place within the housing.

Figure 14:
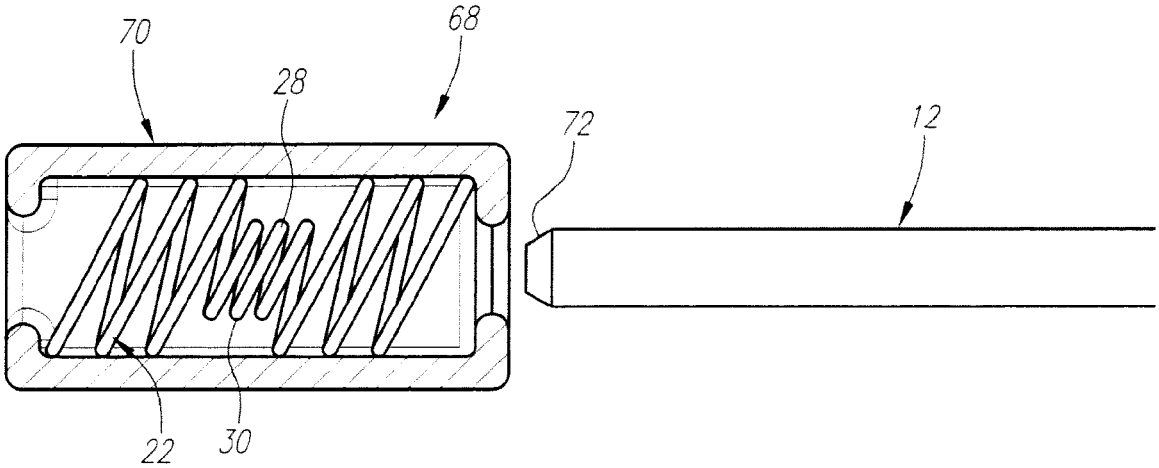
FIG. 14 is a schematic partial cross-sectional side view of the connector of FIG. 13, before insertion of the pin into the housing.

FIG. 14 shows the same assembly 68 as in FIG. 13 and with a pin 12 that can achieve spring contact when inserted into the housing 70 and contacting the small diameter coils 30 of the spring contact 22. The pin 12 may consist of a tapered end 72 to facilitate insertion. It should be noted that the contact assembly 68 is not limited to the particular arrangement of coils that is illustrated (i.e. larger coils to contact the housing at each end with smaller coils to contact the pin in between) as any arrangement, such as alternating large-small coils or sections of coils etc., can achieve the same function. Furthermore, the housing 70 may have two or more housing sections with radial and/or longitudinal seams.

Figure 15:
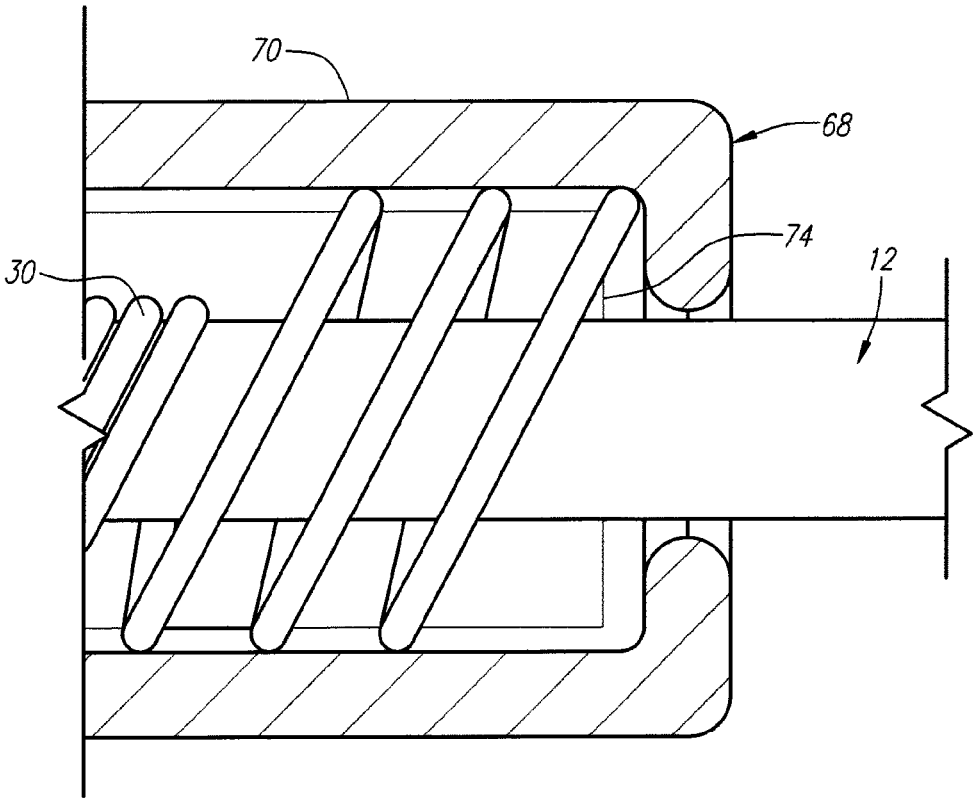
FIG. 15 is an enlarged partial cross-sectional side view of the connector assembly of FIG. 14 with the pin inserted into the housing and contacting some but not all of the coils.

FIG. 15 shows the pin 12 being inserted into the contact assembly 68. Prior to insertion, the open passage 74 (FIG. 13) through the small coils section 28 of the spring contact 22 is smaller than the OD of the pin 12 in at least one dimension. The open passage 74 may be defined as the opening through which a body may pass through the spring contact 22 along the central axis of the spring contact. Note that the central axis of the spring contact and the open passage is typically not perpendicular to the spring coils since the coils are typically canted, slanted, or tilted. As the pin 12 enters the housing 70 and passes through the smaller diameter coils 30, the coils 30 must un-slant, or become less slanted, to a certain degree to achieve a larger open passage that can accommodate the pin. The un-slanting of the coils is a deflection of the spring contact from the relaxed state. Thus, while the pin 12 is inserted in through the open passage 74 of the relative smaller coils, a spring energized contact is maintained between the spring contact 22 and the pin 12.

Figure 16:
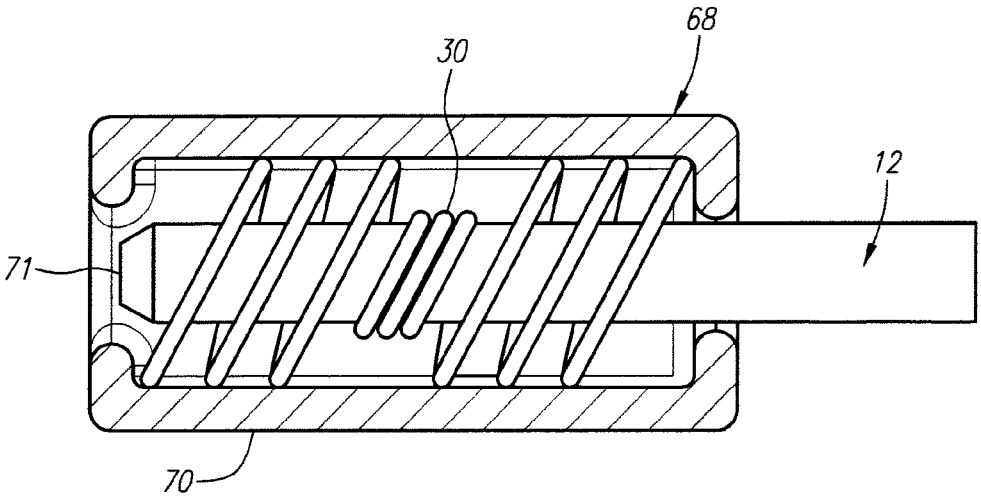
FIG. 16 is a partial cross-sectional side view of the connector assembly of FIG. 15 with the pin inserted into the housing and contacting some but not all of the coils.

FIG. 16 shows the pin 12 fully inserted into the contact assembly 68. The end 71 of the pin 12 may be contained within the cavity of the housing 70 or may extend out of and external of the housing. Note that the angle of the smaller diameter coils 30 in contact with the pin 12 is now less slanted than before the pin insertion (FIG. 14). Furthermore, since the length of spring coil wire is fixed, the spacing between coils may be reduced when the coils become less slanted. As shown, the smaller coils 30 appear to contact one another. However, there may be small gaps between the smaller coils 30.

Figure 17:
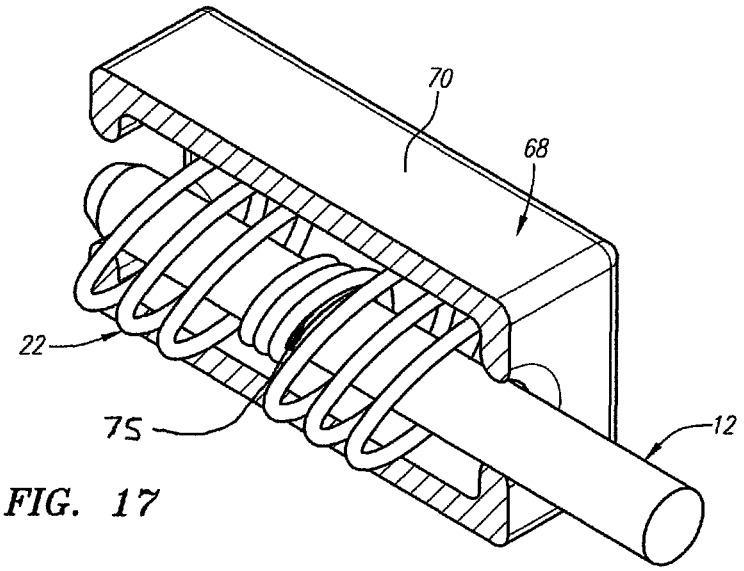
FIG. 17 is a cross-sectional perspective view of the connector of FIG. 16.

FIG. 17 shows the same assembly 68 as FIG. 16 but in an isometric view. In one example, the pin 12 may incorporate one or more grooves 75 formed upon its outer exterior surface to engage the smaller coils 30. If incorporated, the engagement prevents separation between the coils and the pin.

Figure 18:
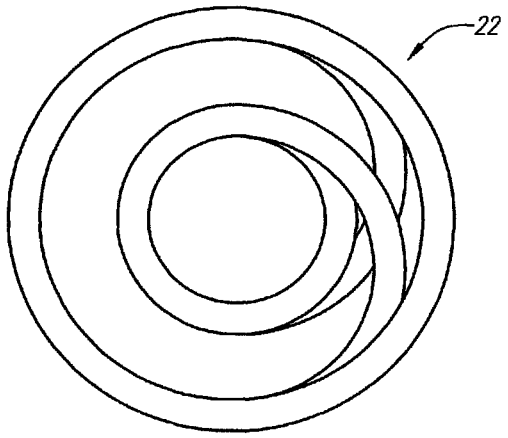
FIG. 18 is a schematic end view of a spring contact provided in accordance with aspects of the present device, system, and method.

FIG. 18 shows an end view of the spring contact 22 looking through the direction of pin insertion. The spring contact would typically have an elliptical cross-section when viewed through the spring axis.

Figure 19:
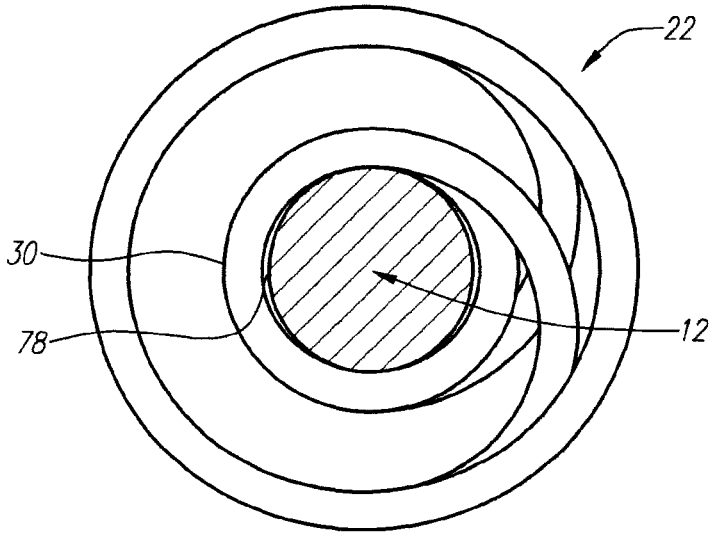
FIG. 19 is a partial cross-sectional end view of the spring of FIG. 18 having a pin disposed therethrough.

FIG. 19 shows a cross-section end view of the pin 12 with the pin inserted in the spring contact 22. The spring contact 22 would typically have an elliptical cross-section when viewed through the spring axis. The smaller spring coils cross-section become less elliptical when the pin is inserted since the coils are being deflected to a lesser slant angle. There will typically be a gap 78 between the pin 12 and the smaller diameter spring coils 30 along the coil width, with the spring contact along the height of the coils. In another example, there are two diametrically opposed gaps 78 between the pin and each coil that the pin contacts. The coil height is the axis perpendicular to the center axis of the spring contact along which the spring wire is most displaced due to coil slant.

Figure 20:
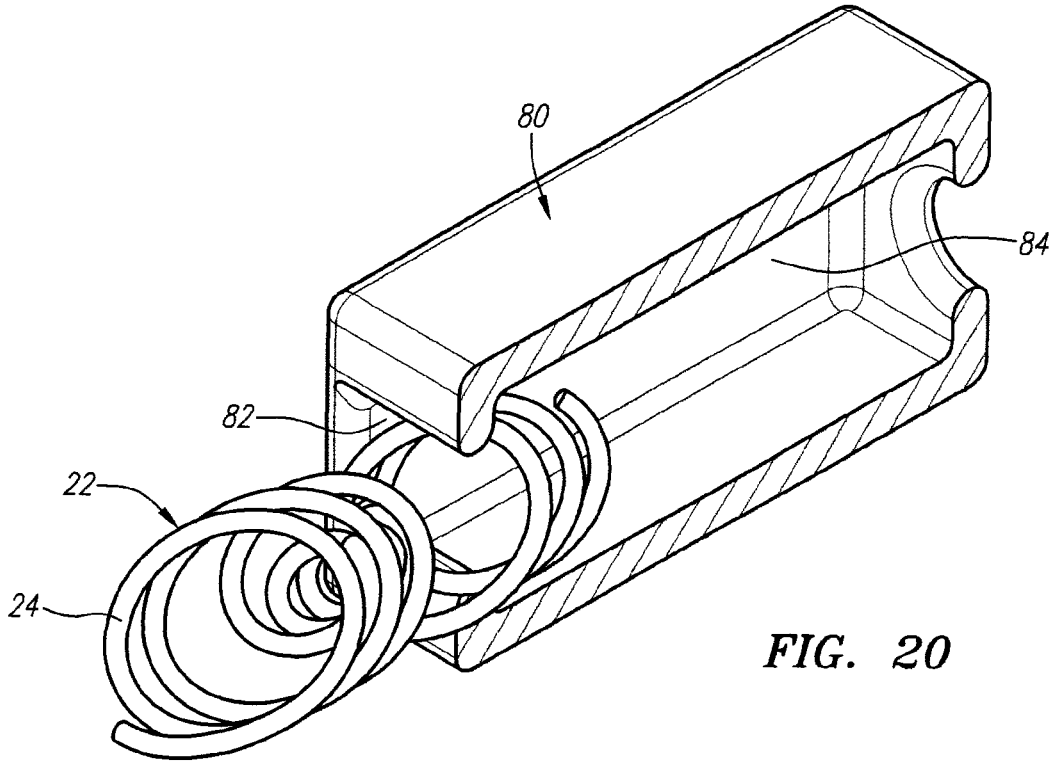
FIG. 20 is a cross-sectional perspective view of a connector assembly provided in accordance with aspects of the present device, system, and method.

FIG. 20 shows a partial perspective and cross-sectional side view of a housing 80 with an opening feature 82 that allows the spring contact 22 to be inserted through and placed into the interior cavity 84 of the housing. In one example, the opening feature 82 shown is a rectangular slot that is wider than the coil width of the large coils 24 of the spring contact 22. The spring contact 22 may be placed into the cavity 84 by further canting the coils from their relaxed state and pushing the spring into the opening 82 of the housing 80 until all the coils are slid through the opening. As each coil enters through the opening 82, it relaxes and cants less than while being pushed through the opening.

Figure 21:
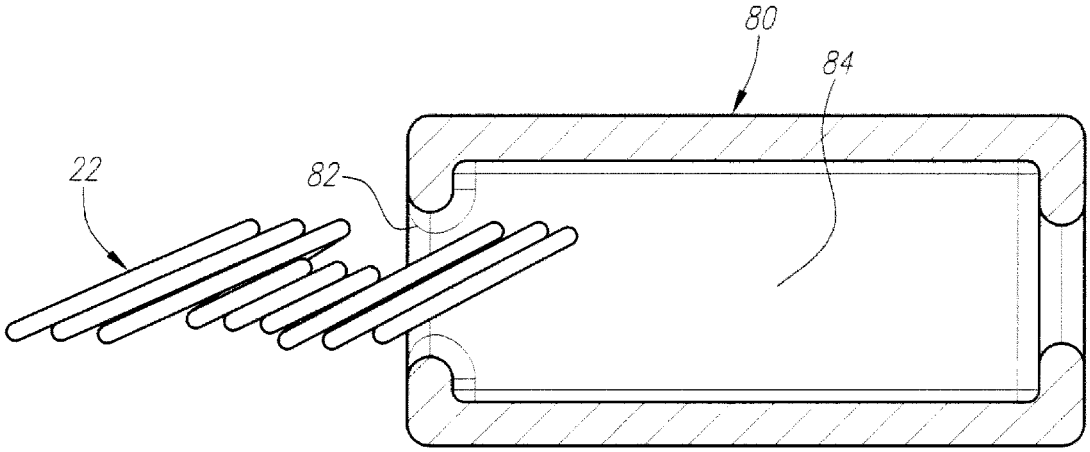
FIG. 21 is a partial cross-section side view of the connector assembly of FIG. 20.

FIG. 21 shows a cross-sectional side view of the same assembly as in FIG. 20. The spring contact 22 must be compressed along the coil height to be inserted through the slot 82. The opening feature 82 allows the spring contact 22 to be inserted into a one-piece housing. In another example, the housing is made from multiple pieces but assembled prior to or after placing the spring contact 22 into the interior cavity 84.

Figure 22:
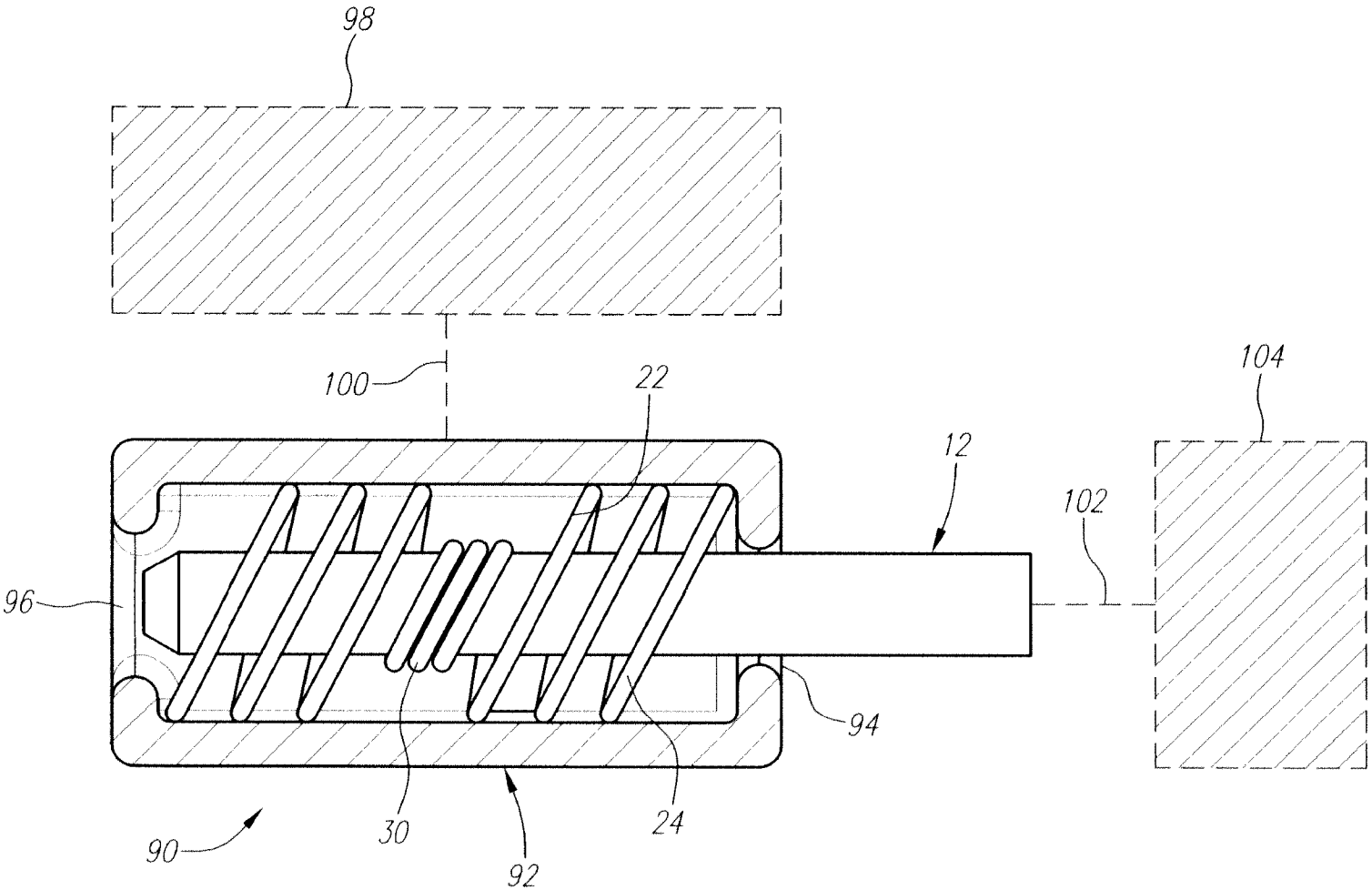
FIG. 22 is a schematic view of a connector assembly connected to a pin and the two connected to a first source and a second source, respectively.

FIG. 22 shows a contact assembly 90 comprising a housing 92 having a spring contact 22 disposed therein with the larger OD coils 24 in contact with the interior surface of the housing. The housing 92 comprises a first opening 94 and a second opening 96. In an alternative embodiment, the housing 92 has two open ends having two end caps (not shown, similar to FIG. 9) attached thereto and wherein each end cap has an opening that is smaller than the housing open ends. In another embodiment, one of the end caps is solid and does not have an opening. In yet other embodiments, the housing is similar to one of the housings discussed elsewhere herein. As shown, a pin, rod, or shaft 12 is inserted through the housing 92 so that the smaller OD coils 30 contact and grip the outer exterior surface of the pin 12.

Assuming the contact assembly 90 has a left side, a middle section, and a right side looking from the perspective of FIG. 22, the smaller OD coils 30 may be located only at the middle section as shown. In another example, the smaller OD coils are located only at the left side, only at the left side and the right side, only at the right side and the middle section, or only at the left side and the middle section. In another example, the contact assembly is understood to include a first end, a second end, and a center section.

The housing, the pin, and the spring contact are all made from an electrically conductive material or all comprise an electrically conductive material. Contacts between the smaller OD coils 30 and the pin 12 permit electrical communication between the pin and the spring contact 22. Similarly, contacts between the larger OD coils 24 and the housing 92 permit electrical communication between the spring contact 22 and the housing 92. As such, electrical communication is established between the pin and the housing through the spring contact.

Also shown in FIG. 22 is a first cable or wire 100 connecting a first electronic or electrical source 98 to the contact assembly 90, such as to the housing 92 of the contact assembly. A second cable or wire 102 connects a second electronic or electrical source 104 to the pin 12. Thus, the first source 98 is understood to be in electrical communication with the second source 104 through the contact assembly 90 and the pin 12. In practice, the first source 98 and the second source 104 may embody any number of electrical devices or components or part of power sources that are intended to be connected to one another via or by way of the contact assembly 90. For example, the first source can be a starter in an automobile and the second source a car battery. The first source and the second source can also be part of a switch gear, a plug and a receptacle, a motherboard and a power supply, a generator and a battery, a controller and a PCB board, part of a wind turbine electrical system, part of a computer system, part of a controller system, part of an electrical musical instrument, part of a consumer electronic equipment, or any number of devices.

Aspects of the present disclosure are further understood to include methods for fabricating a contact assembly disclosed elsewhere herein, for using a contact assembly disclosed elsewhere herein, for supplying a contact assembly disclosed elsewhere herein, and for distributing a contact assembly disclosed elsewhere herein.

Although limited embodiments of spring connectors, systems, and methods and their components have been specifically described and illustrated herein, many modifications and variations will be apparent to those skilled in the art. For example, the various components may be made from different materials than described, made from multiple components that are assembled together, made to indirectly couple, painted or highlighted with colors, include hooks and pockets or other appendages for latching, locking, holding, and electrical contacts, etc. Furthermore, it is understood and contemplated that features specifically discussed for one connector assembly may be adopted for inclusion with another connector assembly, provided the functions are compatible. Accordingly, it is to be understood that the spring connectors and their components constructed according to principles of the disclosed device, system, and method may be embodied other than as specifically described herein. The disclosure is also defined in the following claims.

The invention claimed is:

1. A contact assembly comprising:

a spring contact comprising a plurality of coils interconnected with one another such that each portion of the plurality of coils are canted toward a common direction and at least some of the coils have outside diameters of different outside dimensions; the spring contact comprising a first end, a second end, a center section and an open passage through the plurality of canted coils;

a housing comprising an interior cavity; wherein the spring contact is located, at least in part, inside the interior cavity of the housing and wherein the first end and the second end are spaced from one another and some of the plurality of coils do not contact the housing: and wherein a pin is disposed in the open passage of the plurality of coils.

2. The contact assembly of claim 1, wherein the first end has coils with an outside diameter that differs from an outside diameter of the second end.

3. The contact assembly of claim 1, wherein the first end has a coil with a coil diameter that is the same as a coil diameter of at least one coil at the second end.

4. The contact assembly of claim 1, wherein the interior cavity of the housing comprises an inside diameter and the housing comprises at least one opening at an end of the housing through which the spring contact is inserted, the at least one opening having a smaller diameter than an outside diameter of at least two coils of the plurality of coils and smaller than the inside diameter of the interior cavity.

5. The contact assembly of claim 1, wherein the housing has a longitudinal seam along a lengthwise axis.

6. The contact assembly of claim 1, wherein the pin comprises a tapered insertion end.

7. The contact assembly of claim 1, further comprising a first source in electrical communication with a second source.

8. The contact assembly of claim 7, wherein the first source is connected to the housing by a first cable or a first wire and the second source is connected to the pin by a second cable or a second wire.

9. A method for forming a contact assembly comprising: providing a spring contact comprising a plurality of coils interconnected with one another such that each portion of the plurality of coils are canted toward a common direction and at least some of the coils have outside diameters of different outside dimensions and having an open passage through the plurality of canted coils; the canted coil spring contact comprising a first end, a second end, and a center section and wherein the plurality of canted coils are canted to a respective relaxed state;

providing a housing comprising an interior cavity and at least one open end; and placing the canted coil spring contact into the interior cavity of the housing through the at least one open end such that the first end and the second end are spaced from one another and wherein some of the plurality of coils do not contact the housing;

placing a pin through the open passage of the canted coil spring contact; and wherein insertion of the pin causes at least one of the plurality of coils to enlarge by deflecting more upwardly and less canted.

10. The method of claim 9, further comprising slanting or canting the plurality of coils from their respective relaxed state prior to placing the spring contact into the interior cavity of the housing.

11. The method of claim 9, wherein the center section of the spring contact does not contact the housing.

12. The method of claim 9, wherein the at least one open end has a smaller diameter than outside diameter of at least one of the plurality of coils.

13. The method of claim 9, wherein the pin comprises a tapered insertion end.

14. The method of claim 13, further comprising forming a plurality of grooves on an exterior of a pin and passing the pin through a passage of the spring contact.

15. The method of claim 13, further comprising placing a first source in electrical communication with a second source.

16. The method of claim 15, further comprising using a first cable or a first wire to connect the first source to the contact assembly and using a second cable or a second wire to connect the second source to the pin.

17. A contact assembly comprising a housing and a spring contact located therein in electrical contact with a pin; wherein the spring contact comprises a plurality of coils interconnected with one another such that each portion of the plurality of coils are canted toward a common direction and provide an open passage through the plurality of canted coils which include a first diameter and a second smaller diameter; wherein the pin causes at least one of the plurality of coils with the second smaller diameter to enlarge by deflecting more upwardly and less canted.

18. The contact assembly of claim 17, wherein the housing comprises an inlet opening comprising a width and wherein the width of the inlet opening is larger than a coil width of a largest coil.

19. The contact assembly of claim 17, wherein the coils with the first diameter contact the housing but not the coils with the second smaller diameter.

20. The contact assembly of claim 17, wherein the spring contact has a first end and a second end with the first diameter and a center section with the second smaller diameter.

21. The contact assembly of claim 17, wherein the contact assembly further comprises a cap attached to one of two ends of the housing.

22. The contact assembly of claim 17, wherein the housing is a one piece housing.

* * * * *

UNITED STATES PATENT AND TRADEMARK OFFICE

CERTIFICATE OF CORRECTION

PATENT NO. : 8,735,751 B2
APPLICATION NO. : 13/453337
DATED : May 27, 2014
INVENTOR(S) : Steve Rust It is certified that error appears in the above-identified patent and that said Letters Patent is hereby corrected as shown below:

On the Title Page

In the title, delete "OF FORMING".

In the Claims

In column 9, line 56, claim 1, delete "section" and insert -- section, --, therefor.

Signed and Sealed this
Thirteenth Day of January, 2015

Michelle K. Lee

Michelle K. Lee
*Deputy Director of the United States Patent and Trademark Office*